US007757446B2

(12) United States Patent
Frederick

(10) Patent No.: US 7,757,446 B2
(45) Date of Patent: Jul. 20, 2010

(54) NON-LOADBEARING WALL SYSTEM IN AN EXISTING BUILDING PRIOR TO CONCRETE SLAB

(76) Inventor: Donny Wayne Frederick, 7744 S. Crest Trail, Bessemer, AL (US) 35022

( * ) Notice: Subject to any disclaimer, the term of this patent is extended or adjusted under 35 U.S.C. 154(b) by 120 days.

(21) Appl. No.: 11/712,936

(22) Filed: Mar. 2, 2007

(65) Prior Publication Data

US 2007/0214736 A1 Sep. 20, 2007

Related U.S. Application Data

(60) Provisional application No. 60/782,814, filed on Mar. 17, 2006.

(51) Int. Cl.
*E04B 1/00* (2006.01)

(52) U.S. Cl. ..... 52/274; 52/264; 52/741.15

(58) Field of Classification Search ..... 52/292, 52/293.1, 295, 238.1, 241, 293.3, 294, 297, 52/428, 434, 433, 264, 274, 267, 741.15, 52/741.13, 745.12

See application file for complete search history.

(56) References Cited

U.S. PATENT DOCUMENTS

| | | | | | |
|---|---|---|---|---|---|
| 691,599 | A | * | 1/1902 | Clark | 52/292 |
| 2,200,636 | A | | 5/1940 | Palmer | |
| 2,966,708 | A | * | 1/1961 | Freeman, Jr. | 52/696 |
| 3,055,460 | A | * | 9/1962 | Maroney | 52/293.3 |
| 3,087,586 | A | * | 4/1963 | Gray | 52/241 |
| 3,092,219 | A | * | 6/1963 | Young | 52/775 |
| 3,170,269 | A | * | 2/1965 | Dunnington | 52/293.3 |
| 3,292,328 | A | * | 12/1966 | Darling et al. | 52/238.1 |
| 3,442,188 | A | * | 5/1969 | Rappas | 404/48 |
| 3,508,365 | A | * | 4/1970 | Ellis | 52/169.1 |
| 3,513,606 | A | * | 5/1970 | Jones | 52/27 |
| 3,527,006 | A | * | 9/1970 | Hanson | 52/241 |
| 3,623,288 | A | | 11/1971 | Horowitz | |
| 4,027,439 | A | * | 6/1977 | Willard | 52/79.1 |
| 4,263,762 | A | | 4/1981 | Reed | |
| 4,287,698 | A | * | 9/1981 | Baus | 52/741.4 |
| 4,356,675 | A | | 11/1982 | Reicherts | |
| 4,455,104 | A | * | 6/1984 | Weisbach | 404/50 |
| 4,530,194 | A | * | 7/1985 | Linton et al. | 52/712 |
| 4,658,556 | A | * | 4/1987 | Jenkins | 52/317 |
| 4,756,133 | A | | 7/1988 | Madray | |
| 4,813,494 | A | * | 3/1989 | Beard et al. | 173/91 |
| 4,904,111 | A | * | 2/1990 | Weisbach | 404/48 |
| 5,140,792 | A | | 8/1992 | Daw et al. | |
| 5,456,441 | A | * | 10/1995 | Callies | 248/521 |
| 5,564,235 | A | | 10/1996 | Butler | |

(Continued)

*Primary Examiner*—David Dunn
*Assistant Examiner*—Daniel Kenny

(57) ABSTRACT

An assembly and process to allow for stud walls to be erected prior to the concrete slab being placed and also used for tenant demising walls before the concrete slab is placed. The Easy Wall Track includes a light gauge channel with a leave in place metal keyway attached to the under side for vertical support. There are metal brackets that support this assembly with a smooth rod or rebar driven in the ground. This allows for the concrete slab to be poured at a later date with almost no formwork needing to be placed. This saves money on material, labor and time on the schedule for the retail development company. The Easy Wall Track is versatile in meeting the needs of retail and commercial construction. With walls being able to be erected prior to the placement of the concrete slab would avert delays related to the concrete work.

12 Claims, 5 Drawing Sheets

U.S. PATENT DOCUMENTS 6,076,311 A * 6/2000 Godfrey ..... 52/143
6,094,872 A * 8/2000 Ward et al. ..... 52/126.4
6,256,960 B1 * 7/2001 Babcock et al. ..... 52/592.1
6,263,622 B1 * 7/2001 Griffin et al. ..... 52/153
6,318,044 B1 11/2001 Campbell
6,526,721 B1 * 3/2003 Nash ..... 52/677
6,550,213 B1 4/2003 Butler
6,647,691 B2 11/2003 Becker et al.
6,983,569 B1 1/2006 Rosenberg
7,024,827 B2 * 4/2006 Gregory et al. ..... 52/157
7,073,296 B2 * 7/2006 Gregory et al. ..... 52/157
7,299,593 B1 * 11/2007 diGirolamo et al. ..... 52/241
7,331,149 B2 * 2/2008 Tollenaar ..... 52/481.1
7,395,999 B2 * 7/2008 Walpole ..... 249/33
2002/0043040 A1 4/2002 Cherry et al.
2003/0111297 A1 * 6/2003 Friedman et al. ..... 187/313
2003/0111585 A1 * 6/2003 Hufnagel ..... 249/3
2004/0050001 A1 * 3/2004 Williams ..... 52/292
2006/0277841 A1 * 12/2006 Majusiak ..... 52/105
2007/0180780 A1 * 8/2007 Foglia ..... 52/92.2
2007/0193202 A1 * 8/2007 Rice ..... 52/733.2

* cited by examiner

NON-LOADBEARING WALL SYSTEM IN AN EXISTING BUILDING PRIOR TO CONCRETE SLAB

RELATED APPLICATIONS

The present application is a continuation application of U.S. provisional patent application Ser. No. 60/782,814, filed Mar. 17, 2006, for EASY WALL TRACK, by Donny Wayne Frederick, included by reference herein and for which benefit of the priority date is hereby claimed.

FIELD OF THE INVENTION

The present invention relates to a horizontal light gauge channel assembly and, more particularly, to a horizontal light gauge channel assembly that allows for a stud wall to be built before the placement of the concrete slab that will be placed at a later date.

BACKGROUND OF THE INVENTION

New retail construction is a very fast paced and difficult type of construction due to the constant changing of tenant leases. During new retail construction the developer always tries to get each tenant to incur as much cost as possible, including pouring their own slab. There are numerous reasons for this, mainly due to the deferral of costs to the tenant and also due to the ease and ability to do the underground rough ins. The underground rough ins include the plumbing of restrooms and electrical for the check out counters.

The developer is responsible for different levels of completion in each tenant space depending on the lease. Some tenant spaces are "total build outs" which means the developer does everything in that space including pouring the slab and all of the finishes specified by the tenant. In these cases the Easy Wall Track would not be needed because the wall, known as the demising wall, that separates that space from the adjacent spaces could be erected on the slab already poured. In most cases tenant spaces are "Dark Boxes" which means the developer does nothing but provide the space separated from the other spaces adjacent to it by the demising wall, before the tenant's contractor mobilizes to the space. What causes the problem is when there are two "Dark Boxes" adjacent to one another, because there is no slab in place to erect the demising wall between the two spaces. As an added bonus there is a leave in place metal keyway that gives the Easy Wall Track its vertical support. This almost eliminates all of the formwork needed for the pouring of the concrete slab at a later date. Also the demising walls are subject to be moved if the leases fall thru. The reason for this invention addresses these problems by providing a way to erect the demising wall between these spaces and also allowing the ability to move the Easy Wall Track to another location without it being destroyed during the moving process.

In the past, the only solution to erect a demising wall between two "Dark Box" tenant spaces was to place a small concrete strip for the demising wall to be erected on. If a tenant lease were to fall thru, the developer would have to remove the concrete strip and replace it at a different location to meet the needs of the new lease.

Placing a concrete strip is very expensive and labor intensive to place. Removing the strip involves breaking out the existing concrete; this is very labor intensive. It is also expensive due to the total loss of the materials in the concrete strip. All of these costs are incurred by the developer. These shortcomings also cost valuable days in the fast paced schedule.

It is therefore an object of the invention to provide a cost efficient assembly and process to erect stud walls prior to the placement of the concrete slab.

It is another object of the invention to provide an assembly and process that provides an efficient way to move tenant demising walls.

It is another object of the invention to eliminate almost all formwork needed for the placement of the concrete slab at a later date.

It is another object of the invention to provide a way to maintain a fast paced schedule.

SUMMARY OF THE INVENTION

In accordance with the present invention, there is provided an assembly and process to allow for stud walls to be erected prior to the concrete slab being placed and also used for tenant demising walls before the concrete slab is placed. The Easy Wall Track includes a light gauge channel with a leave in place metal keyway attached to the under side for vertical support. There are metal brackets that support this assembly with a rebar or steel rod driven in the ground. This allows for the concrete slab to be poured at a later date with almost no formwork needing to be placed. This saves money on material, labor and time on the schedule for the retail development company. The Easy Wall Track is versatile in meeting the needs of the retail and commercial construction industries. With walls being able to be erected prior to the placement of the concrete slab would avert delays related to the concrete work.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
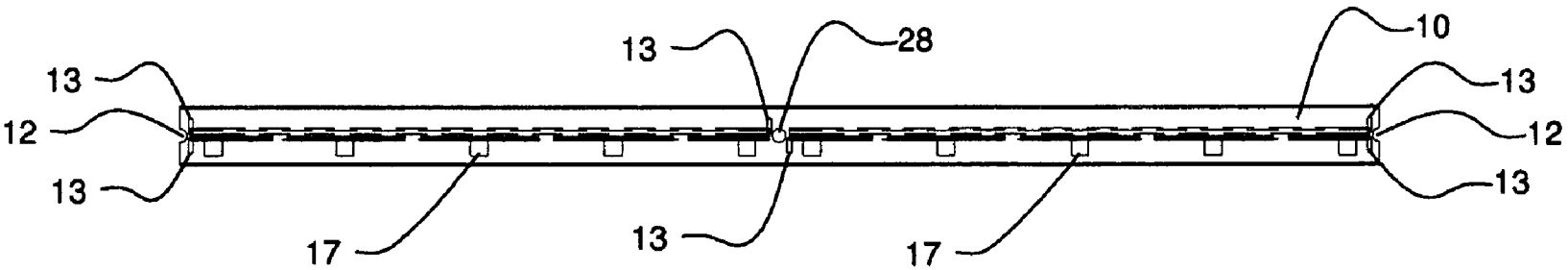
FIG. 1 is a bottom plan view of an assembly without brackets.
Figure 2:
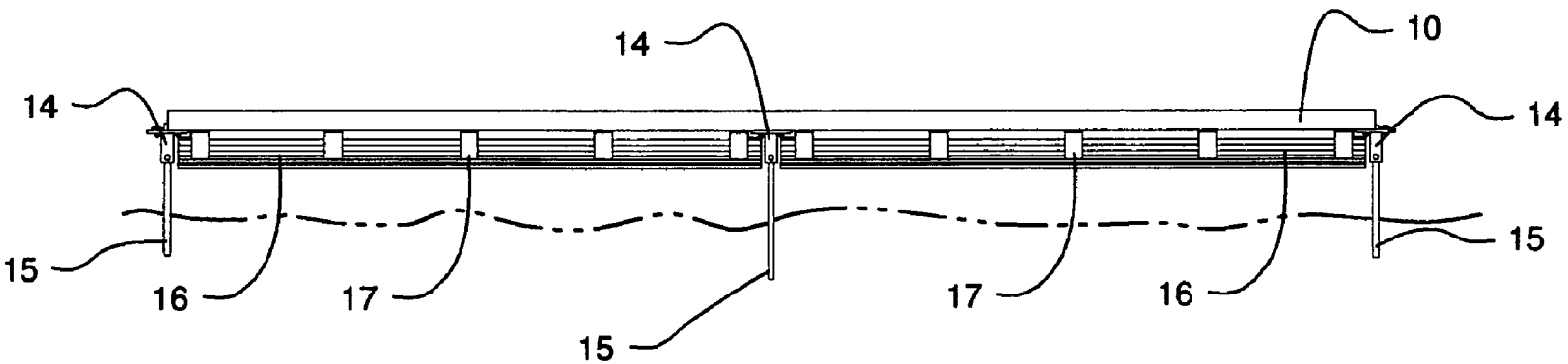
FIG. 2 is a side view of a total assembly.
Figure 3:
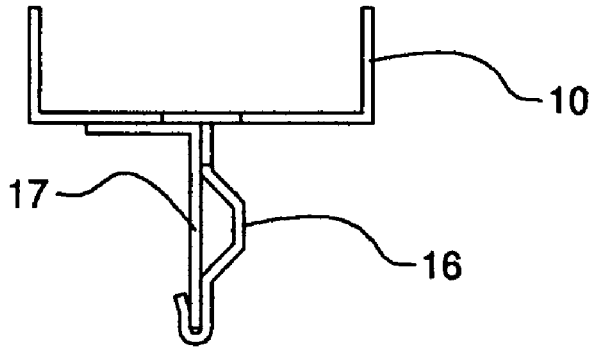
FIG. 3 is a section view of an assembly.
Figure 4:
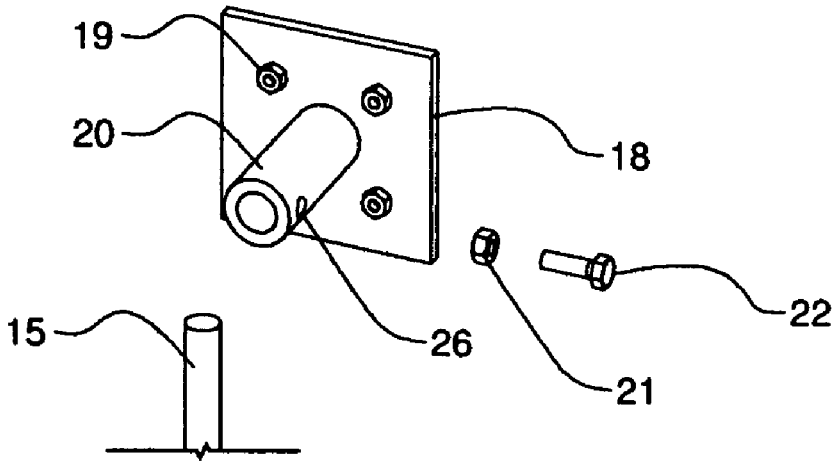
FIG. 4 is a 3*d* view of a bracket.
Figure 5:
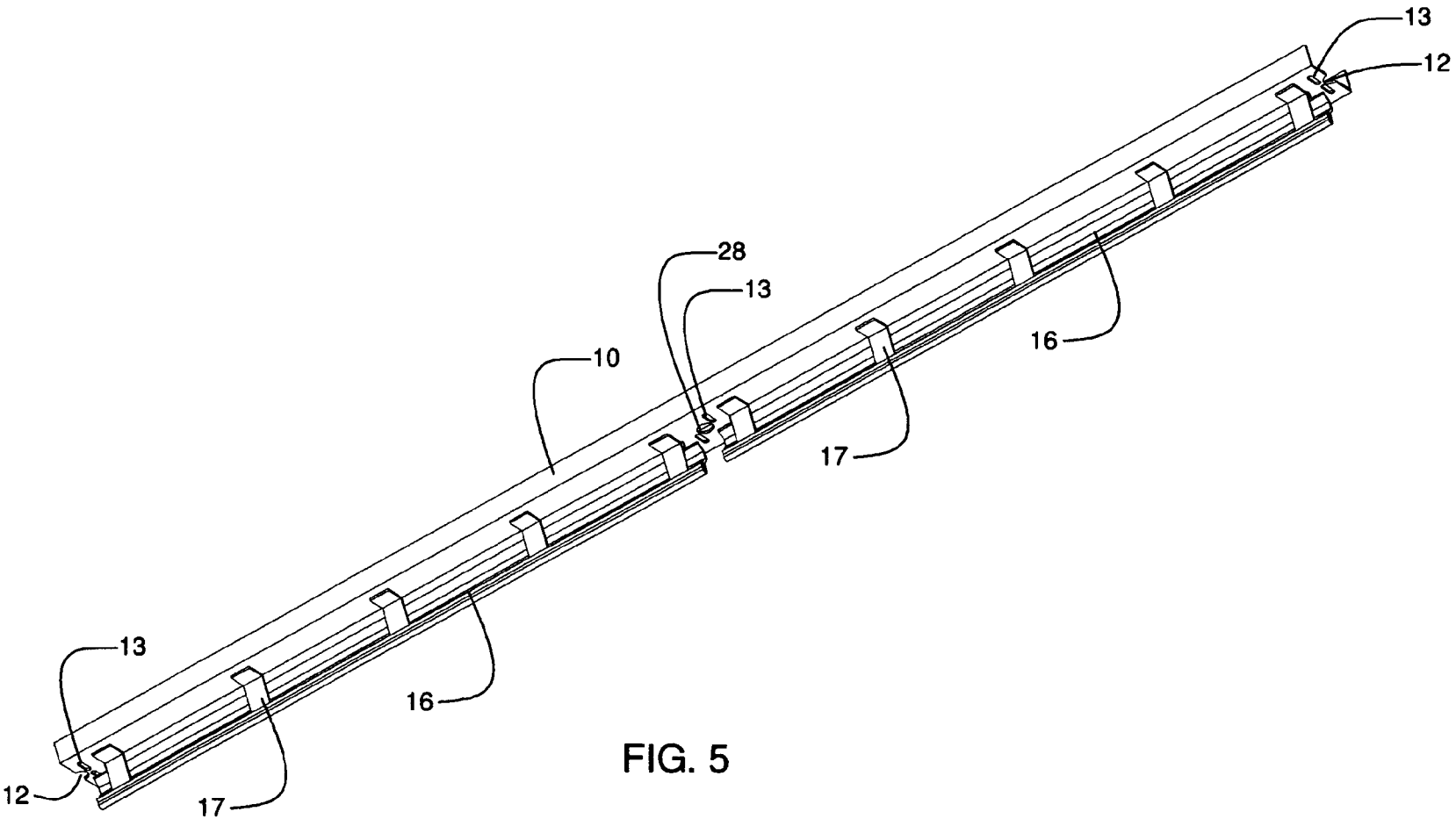
FIG. 5 is a bottom perspective view of an assembly without brackets.
Figure 6:
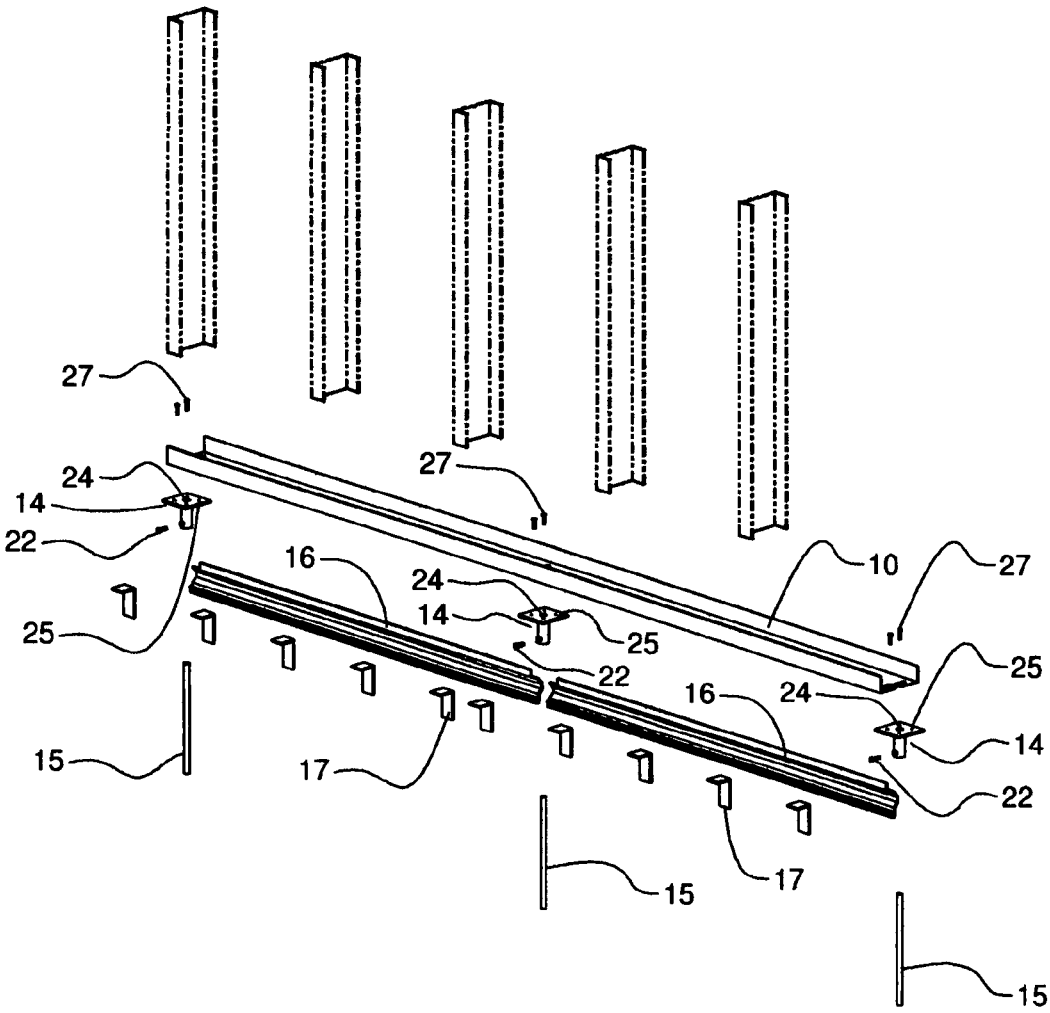
FIG. 6 is an exploded view of a total assembly.
Figure 7:
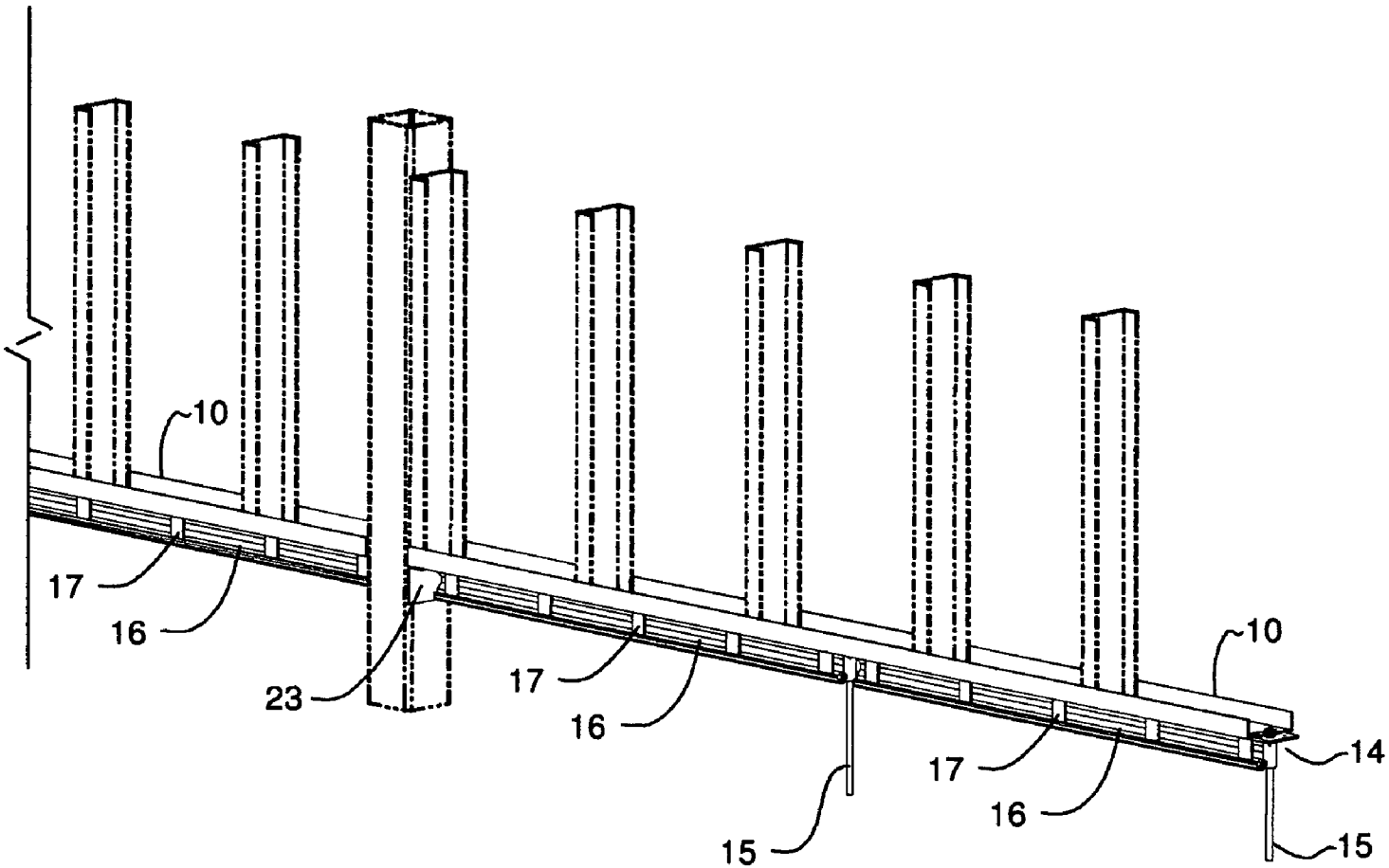
FIG. 7 is a perspective view of a total assembly in place.

The Easy Wall Track consist of a light gauge channel 10 that has six slotted holes 13, two half holes and one full hole 28. At each end of the light gauge channel 10 there are the half holes on the centerline of the light gauge channel 10. At the middle of the light gauge channel 10 on the centerline of the light gauge channel 10 is the full hole 28. There are two slotted holes 13 at each end of the light gauge channel 10 located to coincide with the small holes 25 in the support brackets 14. The other two slotted holes 13 are at the middle of the light gauge channel 10 arranged to coincide with the small holes 25 in the middle support brackets 14. A light gauge leave in place keyway strip 16 is welded to the bottom of it using five light gauge angles 17. The light gauge angles 17 are equally spaced in the spans between two support brackets 14. The Easy Wall Track has a total of three support brackets 14 per 10' piece, one brackets 14 on each end and one brackets 14 in the middle. All brackets 14 are made of a plate 18 with a hole in center of plate 24 and four small holes 25 off center each way. A small nut 19 is welded to the bottom side of the plate 18 at all four of the small holes 25. A piece of pipe 20 with a medium sized hole 26 and medium sized nut 21 welded to the piece of pipe 20 at the medium sized hole 26. The pipe 20 is then welded to the plate 18 centered on the hole in center of plate 24. The light gauge channel 10 is fastened to the support brackets 14 using machine screws 27 through the slotted holes 13 in the light gauge channel 10 into the small nut 19 welded to the bottom side of the plate 18. This allows for the track to be adjustable so it can be easily moved onto the correct alignment. The support brackets 14 will have a piece of smooth rod or rebar 15 driven in the ground thru the full hole 28, half hole 12, the hole in center of plate 24 and through the pipe 20 in the support brackets 14 (the full hole 28 and half hole 12 are oversized to allow for movement around the smooth rod or rebar 15 for the adjustment and alignment. The medium sized nut 21 will have a bolt 22 that passes through the medium sized hole 26 in the pipe 20 in it to allow the brackets 14 to be adjusted up and down to get the track to the precise elevation.) There will also be a use of an angle 23 to support the end of the light gauge channel 10 at a perpendicular wall or a column that is in line with the wall being erected. This would take the place of one of the end support brackets 14.

The process of placing the Easy Wall Track is a simple process. The first thing that is done is to pull a string from one end of the wall that is going to be erected to the other end. The string must be in the precise location, vertically and horizontally. The Easy Wall Track is then laid beside the string end to end. Then starting at one end the Easy Wall Track is held in horizontal place by hand and the smooth rod or rebar 15 is driven through the support brackets 14. After all of the needed smooth rod or rebar 15 are driven then you move to the next step which is the adjusting of the alignment of the Easy Wall Track. Starting from one end, the Easy Wall Track will be adjusted vertically. The Easy Wall Track will be lifted to the same height as the string and then the bolt 22 is tightened on the smooth rod or rebar 15. This holds the Easy Wall Track in place vertically. Next the Easy Wall Track is adjusted horizontally. Starting at one end slide the Easy Wall Track to and from the string until it is on line with the string horizontally. Then tighten the machine screws 27. This holds the Easy Wall Track in place horizontally. Then go back and check all of the Easy Wall Track for alignment vertically and horizontally. There may be a need to make slight adjustments at this time to ensure proper alignment. This is all it takes to place the Easy Wall Track. The studs for the wall that is going to be erected can now be installed.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A system for installing a non-load bearing wall in an existing building before installation of a concrete slab, comprising:

a. a first channel section for supporting the bottoms of wall studs, said first channel section having two ends, and i. being slideably secured to at least 3 support brackets allowing horizontal movement of the first channel section relative to the at least 3 support brackets before being tightened, and ii. containing at least 3 support rod holes, one each of the said at least 3 support rod holes being at the same positions as the at least 3 support brackets so as to allow at least 3 support rods to be driven to the ground through the at least 3 support brackets, b. the at least 3 support brackets being secured to the at least 3 support rods at an optional height off the ground, c. the at least 3 support rods contacting the ground and being secured in the at least 3 support brackets at an optional height off the ground;

d. a keyway strip affixed longitudinally to the bottom of the first channel section at a perpendicular angle, and e. at least one second channel section having two ends, one end of said second channel section secured to one end of the first channel section.

2. The system as in claim 1, in which the keyway strip supports and stiffens the first channel section before the concrete slab is poured and without the keyway strip contacting the ground.

3. The system as in claim 1, in which the keyway strip is deleted and instead there is a rigid member secured underneath near the middle of the first channel section which provides vertical support for the first channel section.

4. The system as in claim 1, in which the at least 3 support brackets do not allow horizontal movement of the first channel section relative to the at least 3 support brackets.

5. A system for installing a non-load bearing wall in an existing building before installation of a concrete slab, comprising:

a. a first channel section for supporting the bottoms of wall studs, said first channel section having two ends, and i. being slideably secured to one center support bracket and to two end support brackets allowing horizontal movement of the first channel section relative to the center and end support brackets before being tightened, and ii. containing 3 support rod holes, one each of the said 3 support rod holes being at the same positions as the center and end support brackets so as to allow 3 support rods to be driven to the ground through the center and end support brackets, b. the center and end support brackets being secured to the 3 support rods at an optional height off the ground, c. the 3 support rods contacting the ground and being secured in the center and end support brackets at an optional height off the ground;

d. a keyway strip affixed longitudinally to the bottom of the first channel section at a perpendicular angle, and e. at least one second channel section having two ends, one end of said second channel section secured to one end of the first channel section by means of one of the end support brackets.

6. The system as in claim 5, in which the keyway strip supports and stiffens the first channel section before the concrete slab is poured and without the keyway strip contacting the ground.

7. The system as in claim 5, in which the keyway strip is deleted and instead there is a rigid member secured underneath near the middle of the first channel section which provides vertical support for the first channel section.

8. The system as in claim 5, in which the one center support bracket and the two end support bracket do not allow horizontal movement of the first channel section relative to the center and the two end support brackets.

9. A method for installing a non-load bearing wall in an existing building before installation of a concrete slab, comprising:

a. fixing the height and location for the bottoms of wall studs, b. providing a first channel section to secure the bottoms of the wall studs at the height and the location in step a, c. securing the first channel section at the height and the location in step a, d. securing the first channel section to at least one second channel section or a column or wall of a building, and e. installing the concrete slab after steps a-d.

10. The method as in claim 9 in which the first channel section is supported vertically by securing a rigid member underneath near the middle of the first channel section.

11. A method for installing a non-load bearing wall in an existing building before installation of a concrete slab, comprising:

a. fixing the location for the bottoms of the wall studs, b. providing a first channel section to secure the bottoms of wall studs, c. driving a support rod through each of the end and center support brackets and support rod holes in the first channel section, d. securing the support rods in the center and end support brackets at optional heights off the ground so that the first channel section is fixed at the height at the location in step the, e. joining an end of the first channel section to an end of at least one second channel section or a column or wall of a building, and f. installing a concrete slab after steps a-e.

12. The method as in claim 11 in which the first channel section is supported vertically by securing a rigid member underneath near the middle of the first channel section.

* * * * *